United States Patent [19]

Goldfarb et al.

[11] 3,946,520

[45] Mar. 30, 1976

[54] MAGNETIC DOLL SET WITH THIN SUBSTRATE SUPPORTED BY A FRAME AND BY WALLS THEREON

[76] Inventors: Adolph E. Goldfarb, 4614 Monarca Drive, Tarzana, Calif. 91356; Erwin Benkoe, 17965 Medley Drive, Encino, Calif. 91316

[22] Filed: Feb. 10, 1975

[21] Appl. No.: 548,829

[52] U.S. Cl. ..... 46/240; 46/21

[51] Int. Cl.[2] ..... A63H 33/26

[58] Field of Search ..... 46/239, 240, 45

[56] References Cited

UNITED STATES PATENTS

| | | | |
|---|---|---|---|
| 1,323,232 | 11/1919 | Page | 46/240 |
| 2,441,060 | 5/1948 | Cunningham | 46/240 UX |
| 2,663,967 | 12/1953 | Mathis | 46/240 |
| 2,814,909 | 12/1957 | Knowles | 46/240 |

FOREIGN PATENTS OR APPLICATIONS

| | | | |
|---|---|---|---|
| 144,036 | 12/1951 | Australia | 46/240 |
| 128,699 | 6/1950 | Sweden | 46/240 |
| 1,329,731 | 5/1963 | France | 46/240 |

*Primary Examiner*—F. Barry Shay
*Attorney, Agent, or Firm*—Robert M. Ashen; Robert J. Schaap

[57] ABSTRACT

A magnetically operable play doll set which includes a doll and a housing which has a floorboard that is elevated above a supporting surface and is divided by walls into a plurality of rooms with doorways permitting passage of the doll through the doorways and into the various rooms. The floorboard is very thin and is supported by means which secure it to the bottom edges of the walls. The walls are supported by a frame underlying the floorboard. The doll is provided on its bottom surface with a magnet which cooperates with a magnet mounted on a retaining plate. The plate, in turn, is pivotally mounted on a wand. Thus, the child desiring to move the doll may insert the wand having the cooperating magnet under the floorboard. The cooperating magnet on the wand will magnetically couple with the magnet on the doll. Inasmuch as the cooperating magnet on the wand is pivotal, the doll will always be moved in a direction with the doll facing forwardly with respect to the direction of movement imparted by the wand.

4 Claims, 7 Drawing Figures

FIG. 1
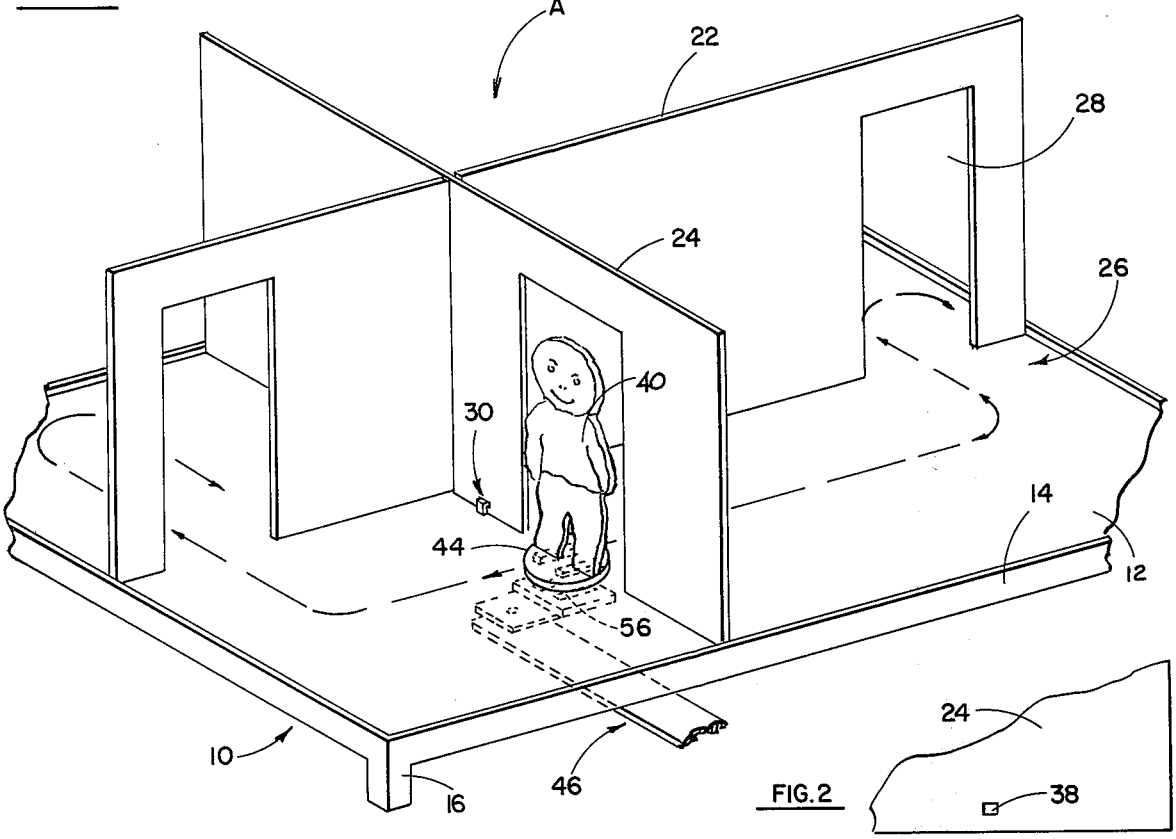
FIG. 2
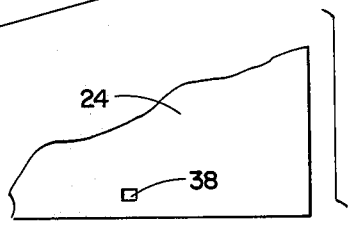
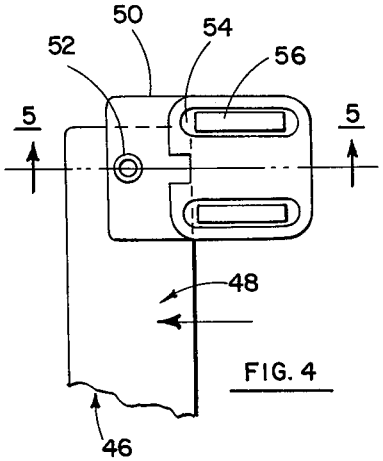
FIG. 4
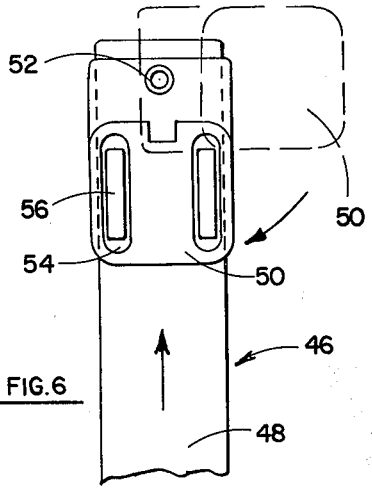
FIG. 6
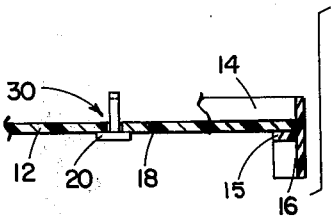
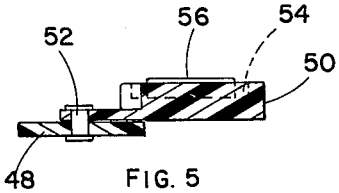
FIG. 5
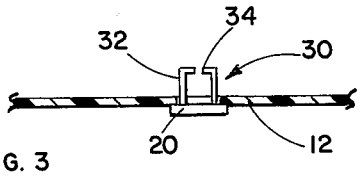
FIG. 3
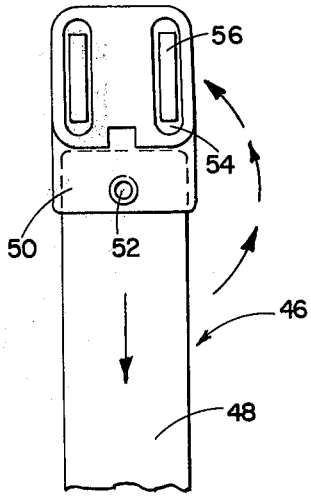
FIG. 7

MAGNETIC DOLL SET WITH THIN SUBSTRATE SUPPORTED BY A FRAME AND BY WALLS THEREON

This invention relates in general to certain new and useful improvements in magnetically operable play doll sets, and, more particularly, to a play doll which is movable through magnetic fields in such manner that the doll normally faces the direction of movement.

There are a number of magnetically operable playing sets in which a child moves one or more movable pieces of the set having a magnet in the movable piece by means of another movable element such as an arm or a wand, which similarly has a magnet to magnetically couple the movable element. This principle has been used to move dolls on various platforms. In this case, the doll is provided with a magnet, generally near its base, and the player of the toy set is provided with a wand which similarly has a magnet on the wand to magnetically couple with the magnet on the base of the doll. Thus, by shifting the wand, the player of the toy can also shift the doll through the magnetic coupling created by the two magnets.

Various toys of the aforementioned type have been produced in a variety of forms. However, one of the principle drawbacks of these toys is that the doll, or other playing piece, can only be magnetically coupled to the movable magnet in one direction, such that the poles of the magnets are located to create the magnetic attraction as opposed to a magnetic repelling. Consequently, if the player of the game engages a wand and moves the doll forwardly, the doll will normally face in the forward direction. However, in the event the player of the toy wishes to shift the doll rearwardly or to the side, the player can only move while the doll is facing in the direction of the player, such that the doll literally appears to moving backwards or sidewise. In essence, the doll is not rotatable with respect to the wand so that the playing toy set lacks some degree of realism.

The present invention obviates these and other problems in the provision of a toy doll set which includes a base wall upon which a doll having a first magnet associated therewith can be shiftable. A wand having a pivotal end section is similarly provided with a magnet to magnetically couple with the magnet associated with the doll. As the mover of the wand locates the end section so that the two magnets are magnetically coupled, the end section will rotate in accordance with the movement of the wand and, in this way, the doll will always face the direction of movement.

It is, therefore, the primary object of the present invention to provide a magnetically operable toy doll set where the player of the toy can move the doll through magnetic coupling in a manner where the doll always faces the direction of movement.

It is another object of the present invention to provide a toy doll set of the type stated which can adopt a variety of formats and settings in order to produce a number of toy play sets on the principal of moving a playing piece in the forwardly facing direction.

It is a further object of the present invention to provide a toy doll set of the type stated which involves a minimum number of movable components and which can therefore be manufactured at a relatively low unit cost.

It is an additional object of the present invention to provide a toy doll set of the type stated which can be manufactured in such manner that it is relatively durable and rigid in its construction and, therefore, is not easily destructible by small children.

It is another salient object of the present invention to provide a toy doll set which can be aesthetically decorated and is thereby very pleasing to a child and which is commercially attractive to children.

With the above and other objects in view, our invention resides in the novel features of form, construction, arrangement and combination of parts presently described and pointed out in the claims.

Having thus described the invention in general terms, reference will now be made to the accompanying drawings in which:

FIG. 1 is a perspective view, partially broken away, of a toy doll set constructed in accordance with and embodying the present invention, and partially shown in dotted lines;

FIG. 2 is an exploded side elevational view, partially broken away, and in section, and showing a portion of connecting various elements of a doll house;

FIG. 3 is a vertical sectional view taken along line 3—3 of FIG. 2;

FIG. 4 is a top plan view, partially broken away, of a wand which is used in connection with the magnetically operable play doll set;

FIG. 5 is a vertical sectional view taken along line 5—5 of FIG. 4;

FIG. 6 is a top plan view, similar to FIG. 5, and showing a magnet containing retaining plate on the wand in a different position, and also showing moving thereof through phantom lines; and FIG. 7 is a top plan view, similar to FIG. 6, and showing the magnet retaining plate totally shifted to a different position.

Referring now in more detail and by reference characters to the drawings which illustrate a preferred embodiment of the present invention, A designates a doll house comprising a frame 10 which retentively holds a relatively flat horizontal wall or floorboard 12. The floorboard 12 is held by and surrounded by a rectangularly shaped side wall 14 and an inwardly struck peripheral flange 15 on the side wall 14. This frame also includes four rectangularly located legs 16 so that a clearance space 18 is provided beneath the flat wall 12 and a table, floor, or other supporting structure.

The floorboard 12 is disposed within the frame 10 and is located so that it snugly engages the interior surfaces of the rectangularly shaped side wall 14. The floorboard 12 may have any form of design or other aesthetic presentation on its upper surface to conform to the setting in which the play doll set would be used.

Provided for securement to the floorboard 12 and the frame 10 is a pair of perpendicularly arranged walls 22 and 24, which are located on the floorboard to form various rooms 26, and at least several of the rooms may be provided with doorways 28 to provide communication between the various rooms 26. Again, the surfaces of the walls could be provided with any form of design or color in order to create the desired setting and, in addition, it should be understood that the play doll set could be provided with other forms of decoration or ornamentation secured to either the floorboard 12 or the walls, or otherwise merely disposed within the walls 22 or 24, or merely disposed within the rooms 26.

The walls 22 and 24 are secured to each other by means of vertically disposed slots formed within the respective walls. Thus, the wall 24 may have a vertically disposed slot extending approximately half-way up its entire vertical dimension, and the wall 22 may have a vertically disposed slot extending half-way down its entire vertical dimension. Thus, these two walls 22 and 24 can be secured together by merely connecting the two walls through the vertically disposed slots.

The walls 24 and 22 could also be secured together in any other form of arrangement. For example, four individual walls could be provided and connected at their ends at a common point of joinder by means of any conventional fasteners, as for example brackets or the like. In addition, the four walls could also be joined by suitable adhesives, etc.

The two walls 22 and 24 in their joined arrangement are secured to the frame 10 through the floorboard 12 by means of a clip 30 which extends upwardly from the base wall 12. In this case, the clip 30 is provided with a pair of upstanding arms 32 which are provided with opposed spaced apart inwardly directed engaging flanges 34. The arms 32 extend upwardly through an appropriately located slot 36 formed in the floorboard 12, and the engageable flanges 34 extend into an aperture 38 formed at the lower portion of one of the walls 24. The arms 32 and the flanges 34 are somewhat resilient so as to permit the snap-fitting engagement. Nevertheless, they are at least sufficiently rigid so that the secured walls 22 and 24 cannot be unauthorizedly removed from the floorboard. An enlarged head 20 is located on the underside of the floorboard 12 to retentively hold the various components in their attached position. This form of construction enables any of a number of vertical dividers to be easily secured to the frame 10 through the floorboard 12 in order to create any of the desired settings.

A doll 40 is movable between the various rooms 26 in the doll house created by the walls 22 and 24, and through the various doorways 28. The doll 40 may adopt any form of desired characterization and appearance. Mounted, preferably at the base of the doll 40, is a plastic disc 42 which is provided with a pair of magnets 44 mounted therein. The base 42 is formed of a paramagnetic material which will not interfere with magnetic coupling. The magnets 44 are preferably aligned with their positive and negative poles in the opposite direction, and are preferably located within recesses formed in the bottom surface of the disc 42.

A wand 46 is provided for shifting the doll 40 in any desired path. The wand 46 includes an elongated arm 48 having an outer end which may be grasped by the player of the play doll set. The inner end of the arm 48 is provided with a pivotally mounted, magnet-containing end section 50, which is pivotally secured to the arm 48 by means of a pin 52. The end section 50 is provided on its upper surface with a pair of opposed spaced apart and parallel recesses 54 in which magnets 56 are physically retained. The magnets 56 may be retained in the recess by any conventional means, as for example, adhesives, or otherwise a snug-fitting engagement within the recesses 54. In the same respect, the magnets 44 are held within recesses formed in the bottom wall of the disc 42 in like manner.

The magnets 56 preferably have the same poles at each of the aligned ends. That is, the outer ends of the magnets 56 would normally both have positive and negative magnetic poles and the opposite aligned other ends would have positive and negative magnetic poles such that magnetic attraction is achieved. In this respect, it should be observed that the disc 42 could be provided with one single magnet and the pivotal magnet retaining section 50 could be provided with one magnet as well; although two magnets are preferred in order to increase magnetic coupling between the disc and the section 50.

By reference to FIGS. 4, 6 and 7, it can be observed that the magnet retaining section 50 has the magnets located at the outer end thereof with respect to the pivot pin 52. In this way, when the arm 48 of the wand 46 is shifted in one direction, the section 50 will swing around due to the inertial moment thereof. Thus, by reference to FIGS. 1 and 4, it can be observed that the section 50 is located so that its longitudinal axis is located in a perpendicular relationship with respect to the longitudinal axis of the arm 48. Thus, when the wand is pushed forwardly, in the direction of the arrow as illustrated in FIG. 6, the section 50 will swing about the pivot point so that the magnets 56 are located rearwardly with respect to the movement of the arm 48, as illustrated by the initial position of the phantom lines in FIG. 6 to the position illustrated by the solid lines in FIG. 6 of the magnets 56.

Inasmuch as the disc 42 is effectively magnetically coupled to the section 50 through the magnets 44 and 56, the doll 40 will also rotate through the same 90° arc. Hence, the forward portion, or face portion, of the doll will project forwardly in the direction of the arrow in FIG. 6. Furthermore, if the player of the toy doll set desires to pull the doll 40 towards the player, the wand 46 would be pulled in the direction of the arrows as illustrated in FIG. 7. In this case, the section 50 will pivot about the pivot pin 52 to the position as illustrated in the dotted lines of FIG. 7 through a 180° arc. Again, the doll 40 will also rotate in this 180° arc inasmuch as the magnets 44 in the disc 42 are magnetically coupled to the magnets 56. Thus, the doll will rotate through the 180° arc and face the direction of movement in accordance with the arrow as illustrated in FIG. 7.

The floorboard 12 is constructed in the form of a somewhat thin membrane, which is supported at its periphery by the flange 15 as aforesaid. The floorboard 12 could be easily constructed with sufficient thickness and rigidity so that it is essentially self-supporting. However, with increased thickness, larger, or at least stronger, magnets would be required to create the desired magnetic coupling through the floorboard. In accordance with the above-outlined construction, the perpendicularly arranged walls 22 and 24 which are secured together as illustrated in FIG. 1 are also supported at their ends on the flange 15. The walls 22 and 24 are constructed with sufficient thickness so that they are self-supporting in their upright position. The clip 30 with the enlarged head 20 engaging the underside of the floorboard 12 essentially permits the major portion of the floorboard 12 to hang from the walls 22 and 24, much in the same manner as a suspension bridge construction. In this way, it can be observed that the floorboard can be made with a relatively thin construction so that it facilitates magnetic coupling therethrough, and provides little barrier to magnetic coupling between the magnets 44 and 56. Thus, it is possible to use smaller or weaker magnets than would be otherwise required.

In accordance with this form of magnetic coupling, it can be observed that the doll will always face the direction of movement of the arm 48 and thereby present a more realistic appearance of movement of the doll 40 with respect to the wand 46.

The various components forming part of the doll house, as well as various components forming part of the wand, except for the magnets in the doll and the wand, can all be constructed of a number of known plastic materials including, for example, polyethylene, polystyrene, polybutadiene, a number of known vinyladiene copolymers, etc. These components may be formed of any of a number of known plastics forming techniques including blow molding, injection molding, thermo-forming and the like. However, it should also be observed that any of the components forming part of the doll or the wand, for that matter, could also be formed of other materials including lightweight metals and the like.

Thus, there has been described a unique and novel toy doll set which permits movement of a doll through a magnetically coupled member in such manner that the doll always faces the direction of movement, and which therefore fulfills all of the objects and advantages sought therefor. It should be understood that many changes, modifications, variations, and other uses and applications will become apparent to those skilled in the art after considering this specification and the accompanying drawings. Therefore, any and all such changes, modifications, variations and other uses and applications which do not depart from the spirit and scope of the invention are deemed to be covered by the invention which is limited only by the following claims.

Having thus described our invention, what we desire to claim and secure by Letters Patent is:

1. A magnetically operable play doll set comprising:

a. a frame, b. a substrate formed of a relatively thin material located on and being partially supported directly by said frame and having a surface permitting a doll to be movable thereon, c. at least one wall supported by said frame, said wall extending across said substrate in generally perpendicular relation thereto, and dividing said substrate into a plurality of room areas, d. said substrate being formed with a thickness such that it is not totally self-supporting on said frame, and said wall being formed of a thickness so that it is self-supporting on said frame in its upright position, e. means operatively securing said substrate to said wall intermediate of spaced sides of said frame so that said substrate is partially suspended from said wall, f. a doll movable on said substrate movable between a plurality of said room areas on said substrate, g. first magnetic means operatively mounted with said doll, h. a wand having a portion locatable under said floor, i. a pivotally mounted extension on said wand locatable in magnetically coupling relationship to said first magnetic means, j. second magnetic means mounted on said extension and being movable therewith, whereby said extension and second magnetic means will pivot on said wand to become aligned with the direction of movement of said wand to orient said doll to face the direction of movement of said wand.

2. The magnetically operable play doll set of claim 1 further characterized in that the first magnetic means comprises a disc mounted in the base of said doll and at least one magnet is mounted in said disc.

3. The magnetically operable play doll set of claim 2 further characterized in that said magnetic means comprises at least one magnet mounted in said pivotally mounted member and extends above the upper surface of said pivotally mounted member.

4. The magnetically operable play doll set of claim 1 further characterized in that said first magnetic means comprises a pair of first spaced apart and parallel magnets and said second magnetic means comprises a pair of second spaced apart and parallel magnets.

* * * * *